United States Patent [19]

Smith

[11] Patent Number: 4,646,382

[45] Date of Patent: Mar. 3, 1987

[54] LOTTERY TICKET SCRAPER

[76] Inventor: Ronald C. Smith, 5211 Los Flores St., Long Beach, Calif. 90815

[21] Appl. No.: 812,355

[22] Filed: Dec. 23, 1985

[51] Int. Cl.[4] ..... A47L 13/02

[52] U.S. Cl. ..... 15/236 R; 15/245; 30/169

[58] Field of Search ..... 30/169; 15/236 R, 236 A, 15/236 B, 100, 245, 256.6, 104 R

[56] References Cited

U.S. PATENT DOCUMENTS

| | | | |
|---|---|---|---|
| 520,818 | 6/1894 | Bettinger | 15/236 R |
| 1,464,264 | 8/1923 | Griswold | 30/169 |
| 2,259,699 | 10/1941 | Larson | 15/245 |
| 2,319,355 | 5/1943 | Storey | 15/245 |
| 2,526,991 | 10/1950 | Biddle | 15/236 R |
| 2,880,505 | 3/1959 | Geery | 30/169 |
| 3,670,414 | 6/1972 | Stecker | 15/236 R |

*Primary Examiner*—Werner H. Schroeder
*Assistant Examiner*—Mary A. Ellis
*Attorney, Agent, or Firm*—Grant L. Hubbard

[57] ABSTRACT

A lottery ticket scraper constructed and arranged so as to scrap opaque coating from only portions of the lottery ticket, including means for supporting the lottery ticket, for aligning the lottery ticket and for scraping the lottery ticket are described.

6 Claims, 6 Drawing Figures be scraped during the scraping operation. The guide is formed along one side of the receiving member for engaging an edge of the lottery ticket during scraping to ensure to correct positioning of the ticket on the receiving member. A generally flat force application member having sides and ends is also provided. A spring return connecting means pivotally interconnects the distal end of the receiving means and the force application means and biases the proximate ends thereof apart to enable the lottery ticket to be inserted there between adjacent the guide. A scraper edge is formed on the proximal end of the force engaging means, extending toward the receiving means for engaging the lottery ticket, when the device is in use, with a sharp scraping edge for removing the coating from a predetermined portion of the lottery ticket. The lottery ticket scraper may also include skirts on the sides of these elements to retain the scrapings inside the lottery ticket scraper.

DESCRIPTION OF THE PREFERRED EMBODIMENT

Figure 1:
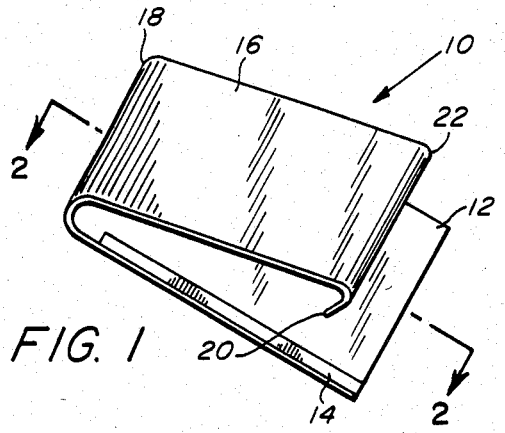
FIG. 1 is a perspective view of a lottery ticket of this invention.
Figure 2:
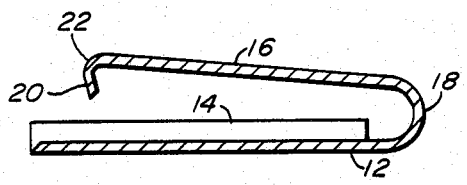
FIG. 2 is a side view in partial cross-section taken along 2—2 shown in FIG. 1 showing the construction of the lottery ticket scraper of this invention.

Reference is made first to FIGS. 1 and 2 for the general construction of the lottery scraper of this invention. The lottery scraper comprises, in combination, and preferably made of a unitary body of material, e.g. sheet metal which is resilient, resilient plastic, such as polyvinylchloride, or other material. The lottery ticket need not be made of a single unitary piece of material, however, but may be made of individual parts connected together. The lottery ticket scraper, indicated generally at 10, comprises a generally flat receiving member having sides and ends, shown in 12, for receiving a portion of the lottery ticket thereupon to be scraped during the scraping operation. A guide 14 is formed along one side of the receiving member for engaging an edge of the lottery ticket during scraping to assure correct positioning of the ticket on the receiving member 12. A force application member, which is preferably generally flat, but may be of any configuration, and having sides and ends, preferably, indicated as 16, is provided and is connected to the receiving member as will be described. A spring return connecting means, indicated at 18, pivotally interconnects the distal ends of the receiving means and the distal end of the force application means and biases the proximal ends of the receiving means and the force application means apart, to permit the lottery ticket to be inserted in between these two elements. The spring return connecting means may be a part of the integral construction, as shown, or may be a leaf spring and a hinge, or any other pivotal connecting means which provides a biasing to perform the biasing and pivoting function described. A scraper edge 20 is connected at the 22 to the proximal end of the force application means and extends towards the receiving means. This scraper edge has a linear, sharp edge for engaging the lottery ticket when it is in use and for scraping opaque coating only from predetermined portions of the lottery ticket, preferably, although the entire lottery ticket can be scrapped using a scraper of appropriate dimensions. It will be understood that the basic elements of this invention are the receiving means for receiving the lottery ticket thereupon, the scraper edge, a guide and means for pressing the scraper edge against the lottery ticket when the invention is in use. The structure described and depicted is a preferred structure, but alternatively structures may be utilized.

Figure 3:
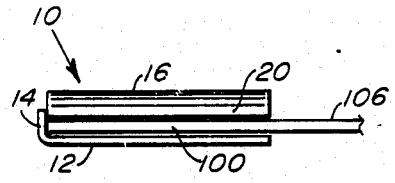
FIG. 3 is an end view of the lottery scraper showing a lottery ticket in position therein for being scraped.
Figure 4:
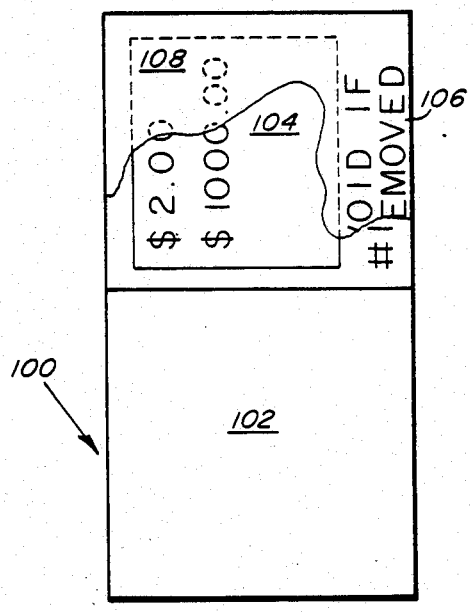
FIG. 4 is a general depiction of a lottery ticket of the type which may be scrapped using this invention.

Referring the FIG. 3, the mode of operation and the position of the lottery ticket in the invention is shown. The ticket, shown generally on 100 in FIG. 4, in the exemplary embodiment, is a generally rectangular cardboard ticket shown at 102, having printed indicia in a field 104 which indicates the value of the ticket, either the amount which was won, and may include a strip 106 which includes a number for the ticket. In many instances, these tickets provide an opaque covering over this number and the ticket is void if removed. The number of the ticket is generally observable only after removing the opaque cover upon which a message such as "void if removed" is printed, warning the user not to remove that portion of the opaque coating. The opaque coating is indicated at 108 in FIG. 4. Returning again to FIG. 3, the ticket 100 is inserted in the scraper 10 with the portion 106 extending outwardly from the scraper and one edge from the ticket engaging the guide 14, the bottom surface being received on the ticket receiving element 12 and the scraper edge 20 engaging the top of the ticket. The user grasps the scraper between the thumb and the forefinger, typically, exerting a compressive force between the support element 12 and the force exerting element 16 to press the scrape edge 20 against the ticket. The ticket is then removed, holding the force thereupon, and the opaque coating is removed by the scraper edge 20, leaving, however, the edge 106 unscraped.

It will be apparent from the foregoing discussion and the drawings, that the ticket scraper is exceedingly simple in operation, but is ingenious in its very simplicity. It can be manufactured economically and made available either free or at a charge by those who sell the lottery tickets.

Figure 5:
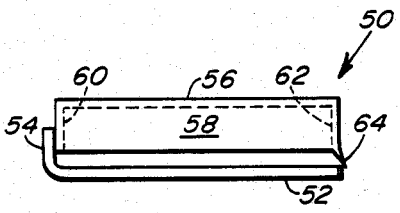
FIG. 5 is an end view, taken from the proximal end, of an alternative embodiment of the lottery ticket scraper showing retainer skirts for retaining the scrapings inside the scraper.
Figure 6:
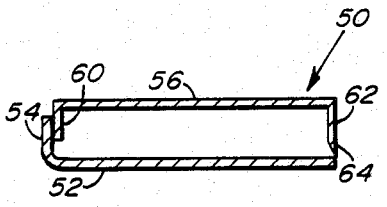
FIG. 6 is a partial cross-sectional view of the scraper of FIG. 5 taken mid-way of the longitudinal direction of the scraper.

An alternative embodiment of the lottery ticket scraper of this invention is shown in FIGS. 5 and 6. The structure is identical to that previously described, except for the additional structure to be described herein after. The scraper includes a ticket receiving means 52, a guide 54, a force exerting means 56 and a scraper edge 58, all of which are identical and perform the same functions for the corresponding elements in the previously described embodiment. In addition, however, the embodiment of FIGS. 5 and 6 includes two downwardly extending skirts, as the figures are orientated in the drawing, these skirts being shown as 60 and 62. The skirt 62 terminates in a thinning portion 64. This scraper is made of flexible material such that the thinning section 64 will simply lay out on the lottery ticket, bending outwardly as the scraper is pressed down on the lottery ticket. This flexible area 64, the lip on the skirt 62, returns to the position shown and the lottery ticket

LOTTERY TICKET SCRAPER

FIELD OF THE INVENTION

This invention relates to gambling generally, and more specifically the invention relates to lottery and lottery tickets. Still more specific, the invention relates to a device for scraping lottery tickets.

BACKGROUND OF THE INVENTION

Human history is cyclic. Civilizations rise from primitive cultures or previously decadent and crushed civilizations, often after a long period of darkness. As civilizations begin a birth, or the rebirth, moral values of the group, and ultimately of the individual rise and become dominate. The wealth of civilizations is often first enjoyed only by a small, select few, sometimes determined by heredity and sometimes by ability. The recognition of moral values, the integrity of the individual, the responsibility of each individual to look after his own needs and to care his own rises as a civilization grows toward maturity. Gradually, the oppressed and the less fortunate begin to partake of the feast of civilization and the conscience of society is turned toward taking care of those who are unable to care for themselves.

Those who have wealth and power are the first to gain education. Education, at first, is a means of enjoying the beauties of the earth, creating beauty, setting standards and values. As education progresses, it becomes more oriented toward occupations and trades and professions and means of earning livelihood. A strong desire for an educated population becomes a dominate drive of a maturing civilization, and the resources of the economy are focused toward educating and preparing those who will assume leadership in the future to assume that leadership is a responsible and ethical manner. As civilization reaches its crowning glory where all who have the drive and the will have the opportunity for education, all have the opportunity for work, and all have the opportunity for individual expression and growth and development, there creeps into civilization a growing proportion of hedonistic cultures whose goal in life is the profligate dissipation of life in sensualistic ritual and a subculture of torpid, shiftless and indolent individuals who live from the charity of others, either through the individual charity of those individuals who have wealth or through government taxation. This later subculture is generally at a very much lower economic status than the majority who have developed civilization to the point of individual responsibility and individual initiative and growth. As these two subcultures continue to grow and develop, they sap the industry and ingenuity of society to the point where a majority of society looks to the minority for its economic support, and a very small minority of society seek only for pleasure.

At this point, the importance of education continues to receive lip service, and the importance of the traditional social and economic values of individual integrity and responsibility continue to be the subject of rhetoric, but the values of society have so shifted that no segment of society desires to pay the price for quality education, but opiate their minds in the vast wastelands of gambling and television. Taxes have been increased to a confiscatory level, and society is unwilling to bear the burden of additional taxes. Demands upon government, as more individual payments are made and social benefits increase bring chaos and dependency. Deficit spending becomes the mode of financial planning, and alternatives to taxation are sought for.

There has existed in this society, from its beginning a small group of business men and others who thrive upon the weaknesses of individuals and of society, making their living through the pedaling of pornography, providing gambling parlors and casinos, and providing an endless train of mindless trivia which passes for entertainment. This group, seeing the opportunity to wedge itself into society through governmental power, persuades the people that they can waste their lives in indolence, attain wealth and solve society's problems through gambling sponsored by the government, bait their trap with a promise of better education for all. Society, thus, succumbs to its lowest elements, and government abandons its rule as a model of integrity and reliability. Thus, the state lottery is born.

With the state lottery comes one of the greatest artistic and wealth-creating inventions of all times, the Lottery Ticket! With the lottery ticket, however, comes a great problem which burdens society. Many lottery tickets include a backing of cardboard or other rigid stock material, printed indicia thereupon, and an opaque coating over some or all of the indicia. The lottery ticket, of this type, is utilized by the purchaser paying money into the state in the hope that by by scraping the ticket he will regain more money than he paid in. The promise is made is that someone will win millions of dollars. The state, however, is careful to minimize the odds against winning any substantial amount are several million to one. Not withstanding, these enormous odds against winning, the population flocks to the grocery store, the service station, the department store, the all-night liquor store, the drug store, and every other conceivable kind of merchandising operation wherein lottery sales have become a major source of activity. As the frantic lottery ticket purchaser grasps his ticket to instant wealth, he is confronted with a virtually insoluble dilemma—how to scrape the lottery ticket! First of all, one must have an object with a sharp edge. Coins are sometimes used, but these have a rounded edge and are most unsatisfactory. Pocket knives are sometimes used, but these tend to cut through the ticket, as well as fingers and thumbs, and destroy it. Nail files, credit card edges, razor blades and virtually every other conceivable kind of device with a sharp edge is used in the frantic race to scrape the opaque covering of the lottery ticket so as to become instantly rich. Most or all of these methods are only moderately satisfactory. One great hazard of most of these methods, lies in the fact that in some kinds of lottery tickets, if the number of the ticket, which is covered by the opaque covering, is disclosed by removing the opaque covering in that area, the lottery ticket is valid. Thus, sadly, the dream of instant wealth is cut asunder by a careless scrape!

The present invention solves this dilemma and frees oppressed society from the risk of destroying the validity of the lottery ticket, and provides a simple, efficient and effective means for scraping lottery tickets.

SUMMARY OF THE INVENTION

The present invention comprises a lottery ticket scraper constructed and arranged to scrape opaque coating from portions of a lottery ticket. The scraper comprises, preferably but not necessarily in a unitary body, a generally flat receiving member which has sides and ends for receiving a portion of the lottery ticket to scraper forms, in effect, a substantially particle type enclosure for retaining the scrapings. This is a great advance over the prior art, in itself, in that society and, in particular, the card parlors where gambling using playing cards occur, have experience exceedingly great problems with their playing cards. Indeed, many of these parlors have ceased to sell lottery tickets because of the users end up with the scrapings on their fingers and these rub off on the playing cards making them sticky and difficult to handle. This burden on society is lifted by means of the present invention.

It will now be understood that the social benefit of this invention in governmental and privately sponsored gambling is great and different in kind from all previously known inventions. By means of this invention, the users may purchase and scrape more lottery tickets faster, filling the coffers of the government with the gambling income and enriching the companies who manage the gambling enterprises. Some of the income may even go to improve education. Thus, the cyclic rise and fall of civilizations will be accelerated and society may look forward to the new rise of a civilization following the deterioration and destruction of such civilization as is presently enjoyed.

It will be understood that the exemplary embodiment is nonlimiting and that the scope of the invention is defined by the claims hereinafter presented.

INDUSTRIAL APPLICATION

This invention finds application in governmental and private gambling industries.

What is claimed is:

1. A lottery ticket scraper constructed and arranged to scrap opaque coating from only portions of a lottery ticket and to leave portions of the lottery ticket unscraped, comprising in combination:

a generally flat receiving member having sides and ends for receiving a portion of the lottery ticket to be scraped thereon during scraping (12);

a guide formed along one side of the receiving member for engaging an edge of the lottery ticket during scraping to assure correct positioning of the ticket on the receiving member (14);

a generally flat force application member having sides and ends (16);

spring return connecting means pivotally interconnecting the distal end of the receiving means and the force application means biasing the proximal ends of the receiving means and the force application means apart (18); and scraper edge means on the proximal end of the force engaging means extending toward the receiving means having a linear, sharp edge for engaging lottery ticket when in use and scraping opaque coating only from predetermined portions of the lottery ticket.

2. The lottery ticket scraper of claim 1 formed unitarily of a single piece of resilient material.

3. The lottery ticket scraper of claim 1 form unitarily of a single piece of metal.

4. The lottery ticket scraper of claim 1 further comprising retaining skirts on the sides of the force application means for retaining scrapings inside the scraper (60, 62).

5. The lottery ticket scraper of claim 4 formed unitarily of a single piece of material.

6. The lottery ticket scraper of claim 4 further comprising a flexible, thinning edge on at least one retaining skirt.

* * * * *